US012604978B2

(12) United States Patent
Ondrasik, Jr.

(10) Patent No.: US 12,604,978 B2
(45) **Date of Patent: *Apr. 21, 2026**

(54) TILTING AND SLIDING SYSTEM FOR A SHELF HAVING SIDE SUPPORT ARMS RECEIVABLE INTO APERTURES IN VERTICAL POSTS

(71) Applicant: THE ONDRASIK FAMILY TRUST DATED 11/3/1999, Commerce, CA (US)

(72) Inventor: V. John Ondrasik, Jr., Granada Hills, CA (US)

(73) Assignee: THE ONDRASIK FAMILY TRUST DATED 11/3/1999, Commerce, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/294,795

(22) Filed: Aug. 8, 2025

(65) Prior Publication Data

US 2025/0359665 A1 Nov. 27, 2025

Related U.S. Application Data

(63) Continuation of application No. 19/047,334, filed on Feb. 6, 2025, now Pat. No. 12,402,725.

(Continued)

(51) Int. Cl.
*A47B 57/38* (2006.01)
*A47B 57/04* (2006.01)

(Continued)

(52) U.S. Cl.
CPC ..... *A47B 57/38* (2013.01); *A47B 57/04* (2013.01); *A47B 57/20* (2013.01); *A47B 57/48* (2013.01);

(Continued)

(58) Field of Classification Search
CPC ..... A47B 57/38; A47B 57/04; A47B 57/20; A47B 57/48; A47B 96/021;

(Continued)

(56) References Cited

U.S. PATENT DOCUMENTS 677,624 A * 7/1901 Beckwith ..... A47B 57/16 211/151
776,233 A * 11/1904 Green ..... A47B 57/16 248/243

(Continued)

OTHER PUBLICATIONS

Drawings, Shelf, Rear Entry, Anthony, Inc., Aug. 4, 2018, 1 page.

*Primary Examiner* — Devin K Barnett
(74) *Attorney, Agent, or Firm* — David R. Heckadon; Gordon Rees Scully Mansukhani LLP

(57) ABSTRACT

A shelving system with a shelf, two rear vertical posts and two front vertical posts. The posts all have vertically spaced apart openings passing therethrough. The shelf has a pair of front side support arms that pass through the apertures in the front vertical posts and a pair of rear side support arms that pass through the apertures in the rear vertical posts. The rear of the shelf can be raised or lowered and re-attached in a new position while the front side support arms remain positioned within the apertures in the front vertical posts. If the rear of the shelf is accidentally dropped, the shelf rotates such that the front side support arms lock against the top and bottom of the vertically spaced apart apertures, thereby preventing the shelf from falling.

15 Claims, 10 Drawing Sheets

Related U.S. Application Data

(60) Provisional application No. 63/674,719, filed on Jul. 23, 2024, provisional application No. 63/574,655, filed on Apr. 4, 2024, provisional application No. 63/551,374, filed on Feb. 8, 2024.

(51) Int. Cl.

| | |
|---|---|
| ***A47B 57/20*** | (2006.01) |
| ***A47B 57/48*** | (2006.01) |
| ***A47B 96/02*** | (2006.01) |
| ***A47B 96/14*** | (2006.01) |
| *A47B 57/06* | (2006.01) |
| *A47B 57/26* | (2006.01) |
| *A47B 57/30* | (2006.01) |

(52) U.S. Cl.
CPC ..... *A47B 96/021* (2013.01); *A47B 96/1408* (2013.01); *A47B 57/06* (2013.01); *A47B 57/26* (2013.01); *A47B 57/30* (2013.01)

(58) Field of Classification Search
CPC ..... A47B 96/1408; A47B 57/06; A47B 57/26; A47B 57/30; A47B 57/16; A47B 57/08; A47B 57/10; A47B 57/14; A47B 57/32; A47B 57/34; A47B 57/40
See application file for complete search history.

(56) References Cited

U.S. PATENT DOCUMENTS

| | | | | |
|---|---|---|---|---|
| 2,872,144 | A * | 2/1959 | Hobson | A47B 57/32 248/225.11 |
| 3,330,229 | A * | 7/1967 | Ferdinand | A47B 57/487 211/187 |
| 3,343,506 | A * | 9/1967 | Buchbinder | A47B 57/16 248/242 |
| 3,705,654 | A * | 12/1972 | Barrineau, III | A47F 5/13 211/187 |
| 3,785,301 | A * | 1/1974 | Lundqvist | A47B 57/20 108/109 |
| 4,292,902 | A * | 10/1981 | Barrineau | A47B 57/10 211/187 |
| 4,928,834 | A * | 5/1990 | Neiman | A47B 57/402 211/208 |
| 5,094,350 | A * | 3/1992 | Smock | A47B 57/04 248/242 |
| 6,302,036 | B1 * | 10/2001 | Carson | A47F 5/0031 211/175 |
| 6,389,993 | B1 | 5/2002 | Ondrasik | |
| 6,490,983 | B1 | 12/2002 | Nicholson et al. | |
| 6,526,897 | B1 * | 3/2003 | Ondrasik | A47B 57/20 108/107 |
| D478,739 | S * | 8/2003 | Sparkowski | D6/675.2 |
| 6,729,484 | B2 * | 5/2004 | Sparkowski | A47F 5/137 211/187 |
| 6,820,754 | B2 | 11/2004 | Ondrasik | |
| 6,920,831 | B2 * | 7/2005 | Lin | A47B 57/408 211/187 |
| 10,660,435 | B2 * | 5/2020 | Miller, Jr. | F25D 25/02 |
| D905,482 | S * | 12/2020 | Coretti, Jr. | D6/675.2 |
| D914,406 | S * | 3/2021 | Ondrasik | D6/675 |
| 11,409,491 | B2 | 8/2022 | Nel | |
| 11,944,213 | B1 | 4/2024 | Ondrasik, Jr. | |
| 12,203,694 | B2 | 1/2025 | Ramirez et al. | |
| 2003/0029362 | A1 * | 2/2003 | Ondrasik | A47B 57/20 108/110 |
| 2003/0084827 | A1 | 5/2003 | Nicholson et al. | |
| 2003/0205876 | A1 * | 11/2003 | Orozco | B62B 3/14 280/79.3 |
| 2004/0065630 | A1 | 4/2004 | Ondrasik | |
| 2016/0029786 | A1 * | 2/2016 | Davis | A47B 91/00 211/208 |
| 2016/0290712 | A1 * | 10/2016 | Tunzi | F25D 27/00 |
| 2019/0239641 | A1 | 8/2019 | Miller, Jr. et al. | |
| 2022/0185352 | A1 * | 6/2022 | Ondrasik, Jr. | B62B 3/1476 |
| 2024/0341467 | A1 | 10/2024 | Chandrashekaraiah et al. | |

* cited by examiner

TILTING AND SLIDING SYSTEM FOR A SHELF HAVING SIDE SUPPORT ARMS RECEIVABLE INTO APERTURES IN VERTICAL POSTS

RELATED APPLICATIONS

This application is a Continuation of U.S. patent application Ser. No. 19/047,334, of same title, filed Feb. 6, 2025, which claims priority to U.S. Provisional Patent Application Ser. No. 63/551,374, also of same title, filed Feb. 8, 2024, and to U.S. Provisional Patent Application Ser. No. 63/574,655, also of same title, filed Apr. 4, 2024, and to U.S. Provisional Patent Application Ser. No. 63/674,719, also of same title, filed Jul. 23, 2024; the entire disclosures of which are incorporated herein by reference in their entireties.

TECHNICAL FIELD

The present invention relates to shelving systems such as shelves used in product display cabinets, behind glass refrigerator doors or any other system where products are placed on shelves in supermarkets, convenience stores or other locations.

BACKGROUND OF THE INVENTION

Many different systems currently exist for positioning shelves. Unfortunately, to change the position of any of these shelves requires relocating insert, brackets, attachments or other system components.

It would instead be desirable to provide a system that allows the shelf to be quickly and easily moved both back and forth (i.e.: in a horizontal direction), up and down and tilted to various non-horizontal angles. Moving the shelf back and forth in a horizontal direction would provide better visibility and would make it easier to remove the product from the shelf. Tilting the shelf would be especially useful to ensure that the products loaded onto the shelf slide forwards towards the front of the shelf for easy customer access. In addition, a shelf that can be tilted (i.e.: with its rear end lifted) and then quickly put back into a horizontal position can be loaded faster than a shelf that remains horizontal at all times. This is because as products are loaded onto the shelf (for example, milk cartons) they will easily slide towards the front of the shelf. Tilting the products forwards against another product will also prevent them from toppling over. Instead, the products will tend to slide towards one another, thereby filling the shelf as it is being loaded. Once the shelf has been fully loaded, it can be pushed back into the frame supporting it and put in a horizontal position again (if so desired). As will be shown, the Applicant's system permits quick, easy and safe movement of the shelf in a horizontal direction. It also permits quick, easy and safe rotation of the angle of the shelf.

In addition, it would also be desirable to provide a shelving system in which the shelf will bind (rather than simply fall) if the rear end of the shelf is accidently dropped when it is being moved. This is especially problematic if there are products or goods sitting on the shelf making it heavier when an operator releases the rear end of the shelf to move the rear end of the shelf upwards or downwards to adjust the angle of the shelf. As will be shown, the Applicant's system solves this problem without requiring springs, brackets or other attachment mechanisms.

SUMMARY OF THE INVENTION

In preferred aspects, the present system provides a shelving system, comprising:

(a) an assembly with:
- two front vertical posts having a series of vertically spaced apart apertures passing therethrough, and
- two rear vertical posts having a series of vertically spaced apart apertures passing therethrough; and (b) a shelf comprising:
- a main body,
- a pair of front side support arms extending from opposite sides of a front portion of the main body, wherein the front side support arms enter or extend through the vertically spaced apart apertures in the front vertical posts, and
- a pair of rear side support arms extending from opposite sides of a rear portion of the main body, wherein the rear side support arms enter or extend through the vertically spaced apart apertures in the rear vertical posts.

An important advantage of the present shelving system is that the rear of the shelf can be raised or lowered and re-attached into a new position while the front side support arms remain continuously positioned within the apertures in the front vertical posts. Therefore, if the rear of the shelf is accidentally dropped, the shelf rotates such that the front side support arms lock against the top and bottom of the vertically spaced apart apertures, holding the shelf and preventing the shelf from falling.

In preferred embodiments, the rear side support arms have a series of bottom notches or protrusions thereon, and these notches or protrusions lock onto the vertically spaced apart apertures in the rear vertical posts. These notches or protrusions may be made in many shapes, including but not limited to cactus-shaped or saw-tooth shaped and may be positioned at many positions with respect to one another. If cactus-shaped or saw-tooth shaped, the notch may optionally have a straight portion that locks against the edges of the vertically spaced apart apertures in the rear vertical posts.

In preferred embodiments, each of the vertically spaced apart apertures in the rear vertical posts may include a front wall aperture and a back wall aperture, with the front wall aperture being positioned lower than the back wall aperture. The advantage of this geometry is that the front side support arms rotate to lock against the top and bottom of the vertically spaced apart apertures if the rear of the shelf is accidently dropped (for example, if the rear side support arms are removed from the vertically spaced apart apertures in the vertical rear posts and the rear portion of the shelf is accidentally released).

In accordance with the present system, the rear of the shelf can be lifted to tilt the shelf forwardly while the front side support arms have entered or extend fully through the vertically spaced apart apertures in the front vertical posts. Similarly, the rear of the shelf can be released and dropped to tilt the shelf backwardly while the front side support arms extend fully through the vertically spaced apart apertures in the front vertical posts. As will be shown, this can be accomplished by having the front side support arms being longer than the rear side support arms.

In preferred aspects, the front and rear vertical posts can be rectangular in cross section. In such embodiments, each of the vertically spaced apart apertures in the front vertical posts preferably include a front wall aperture and a back wall aperture, with the front wall aperture being positioned lower than the back wall aperture. Alternatively, however, the front and rear vertical posts can be many other shapes, including but not limited to being T-shaped, U-shaped, C-shaped or I-shaped in cross section having only one aperture passing therethrough. Optionally, a plurality of shelves may be supported on the left and right sides of the vertical posts (for example in a long horizontal display cabinet). The apertures may be made in the same or different shapes and sizes in the front and rear vertical posts. The size and shape of these apertures will correspond to the size and shape of the side support arms passing therethrough.

As such, the present system provides a novel mechanism for positioning the shelf such that the angle of the shelf and the vertical and horizontal position of the shelf with respect to the vertical posts can both be easily adjusted by easily moving the shelf to various positions.

DETAILED DESCRIPTION OF THE DRAWINGS

The present invention provides various systems for positioning a shelf (which may optionally be a wireframe shelf but is not limited to wireframe shelves) such that both the angle of the shelf and the vertical and horizontal position of the shelf can both be adjusted quickly and easily without the need for moveable inserts, brackets, S-hooks, etc.

Figure 1A:
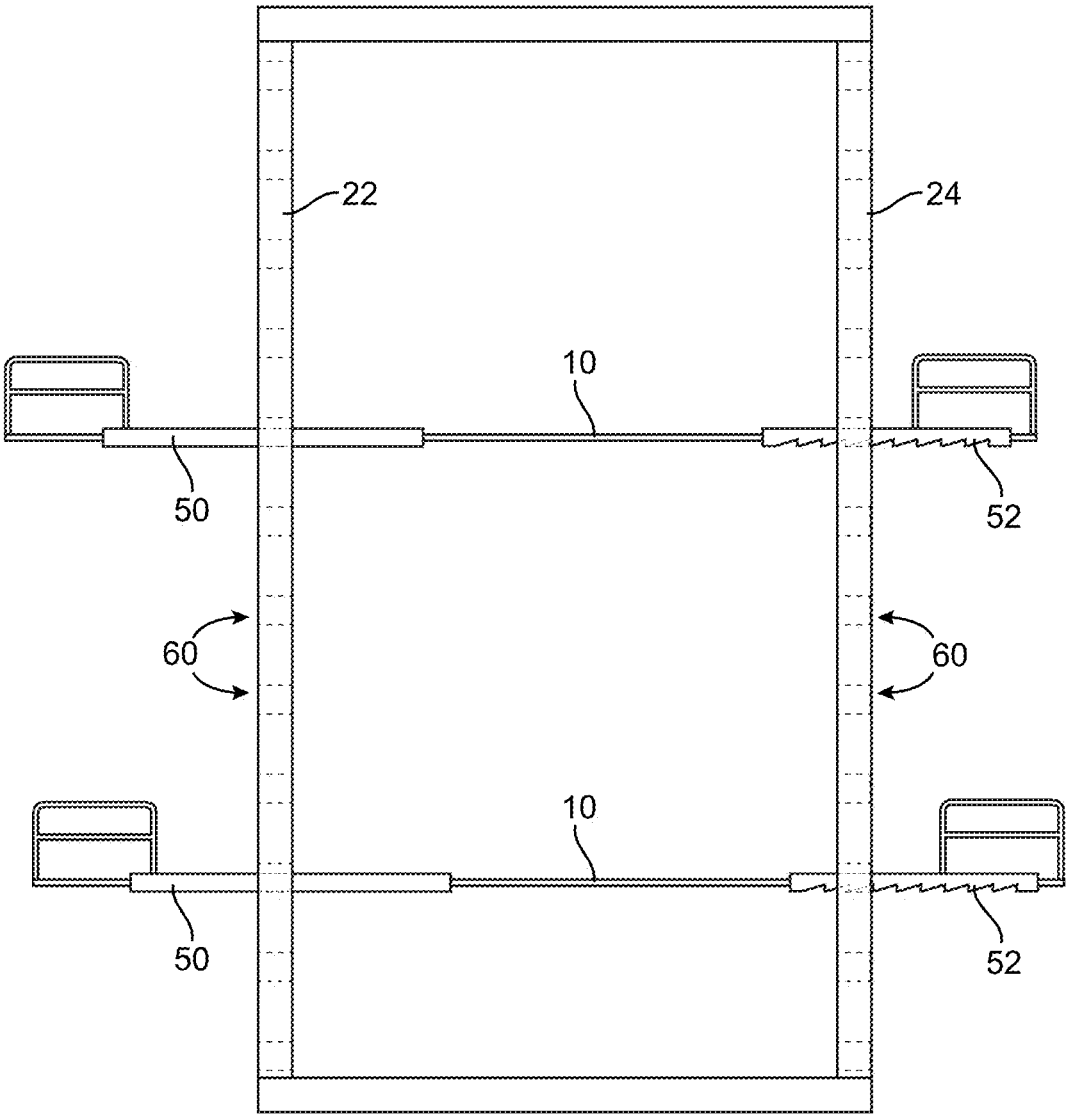
FIG. 1A is a perspective view of the present system with the shelves positioned horizontally.
Figure 1B:
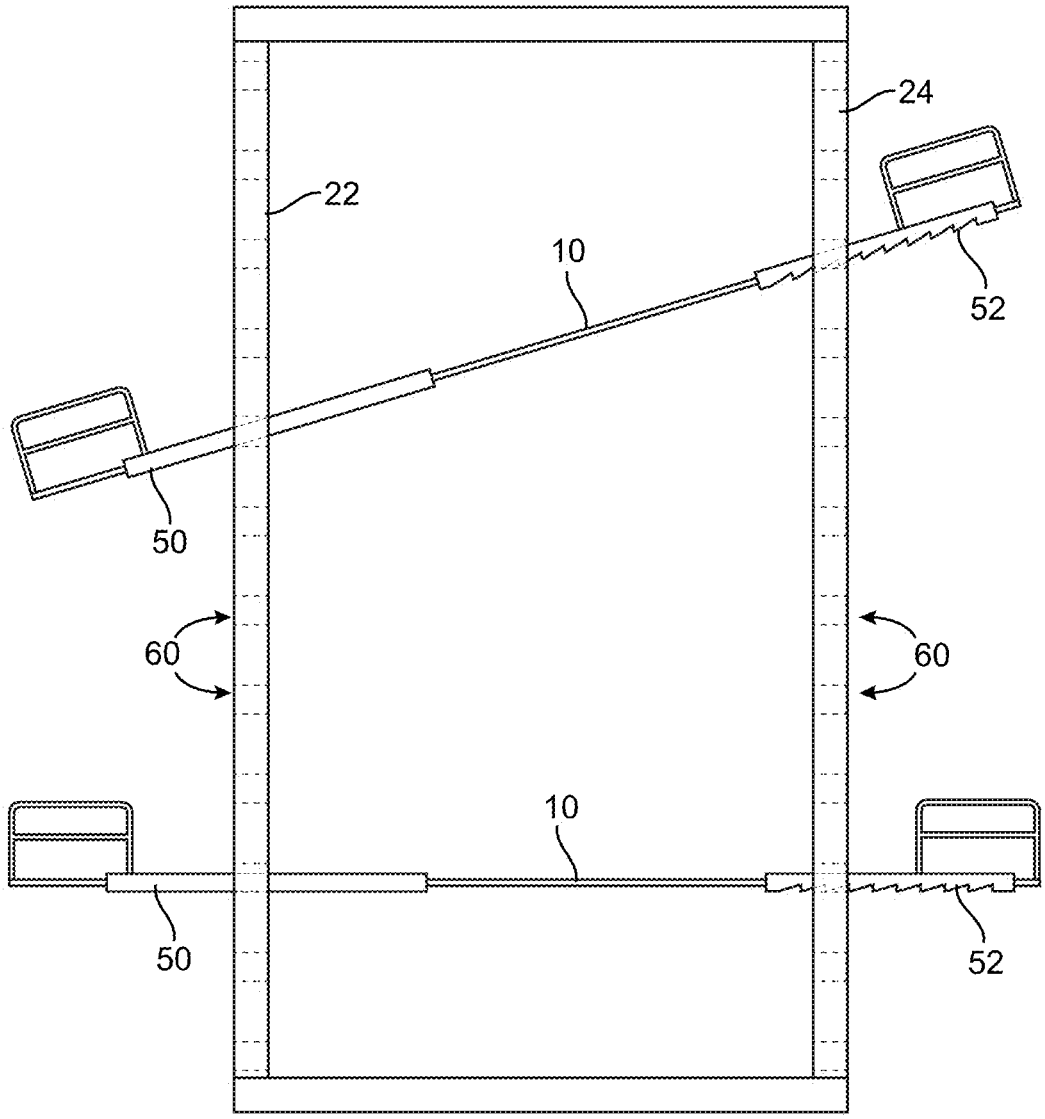
FIG. 1B is a perspective view of the present system with the rear end of one of the shelves in a raised position, tilting the shelf forwards.
Figure 1C:
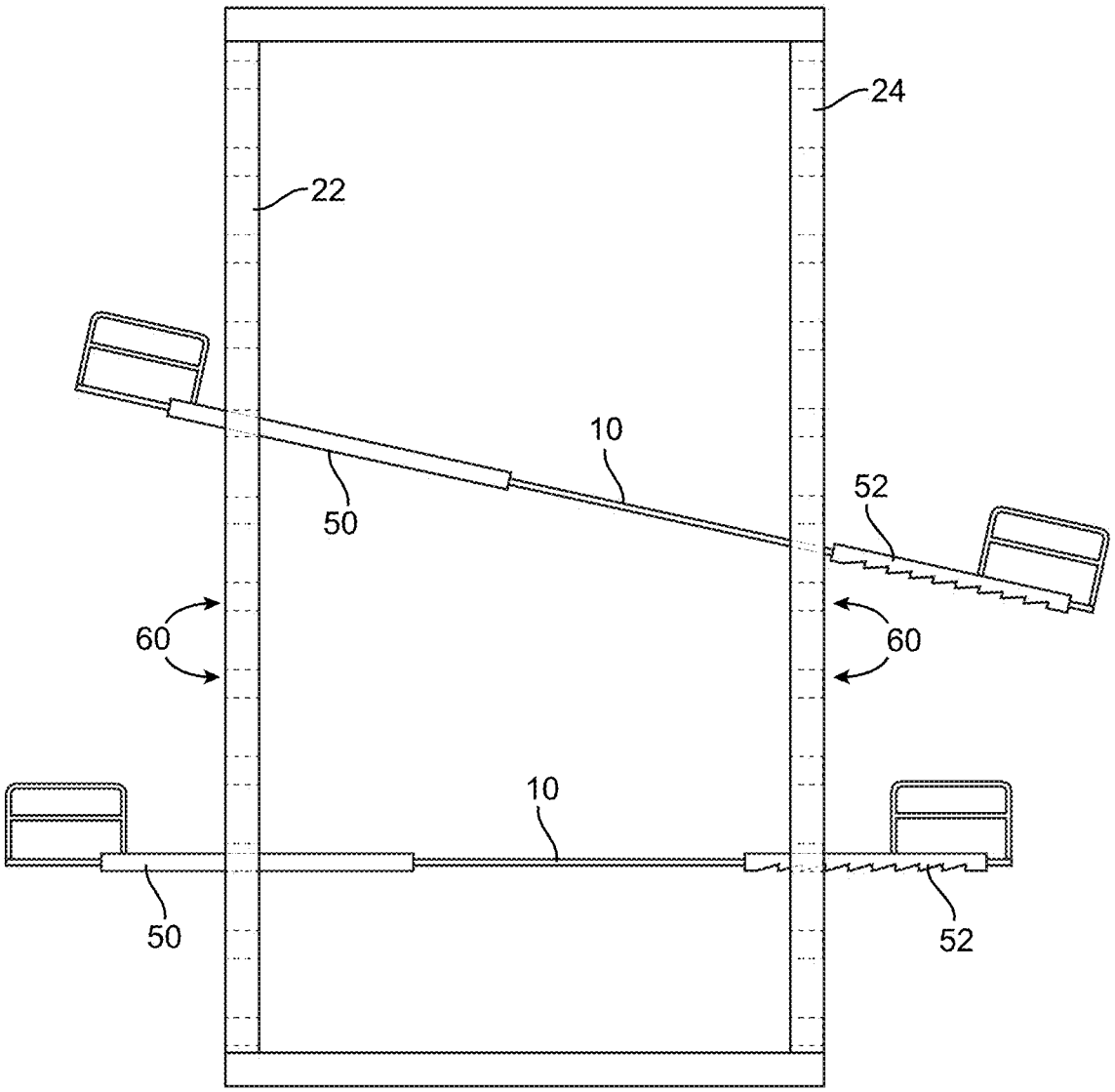
FIG. 1C is a perspective view of the present system with a rear end of one of the shelves in a lowered position, tilting the shelf backwards.

FIGS. 1A, 1B and 1C illustrate various positions of the present shelving system. For clarity of illustration, the shelves are simplified and side stops (which prevent products from falling off the sides of the shelves) are removed. The present shelving system includes two shelves 10, each having a front end that is supported by front vertical posts 22 and a rear end that is supported by rear vertical posts 24. Shelf 10 may be a wireframe shelf or other form of shelf including shelves with continuous solid bottoms, etc. As seen in FIG. 1A, the top shelf 10 may be pulled back, lifted and pushed into a horizontal position. As seen in FIG. 1B, the rear end of top shelf 10 may be lifted and pushed into position. This tilts the shelf forwards. Alternatively, as seen in FIG. 1C, the rear end of top shelf 10 may be pulled back and released. This tilts the shelf backwards, yet the shelf does not fall.

Figure 1D:
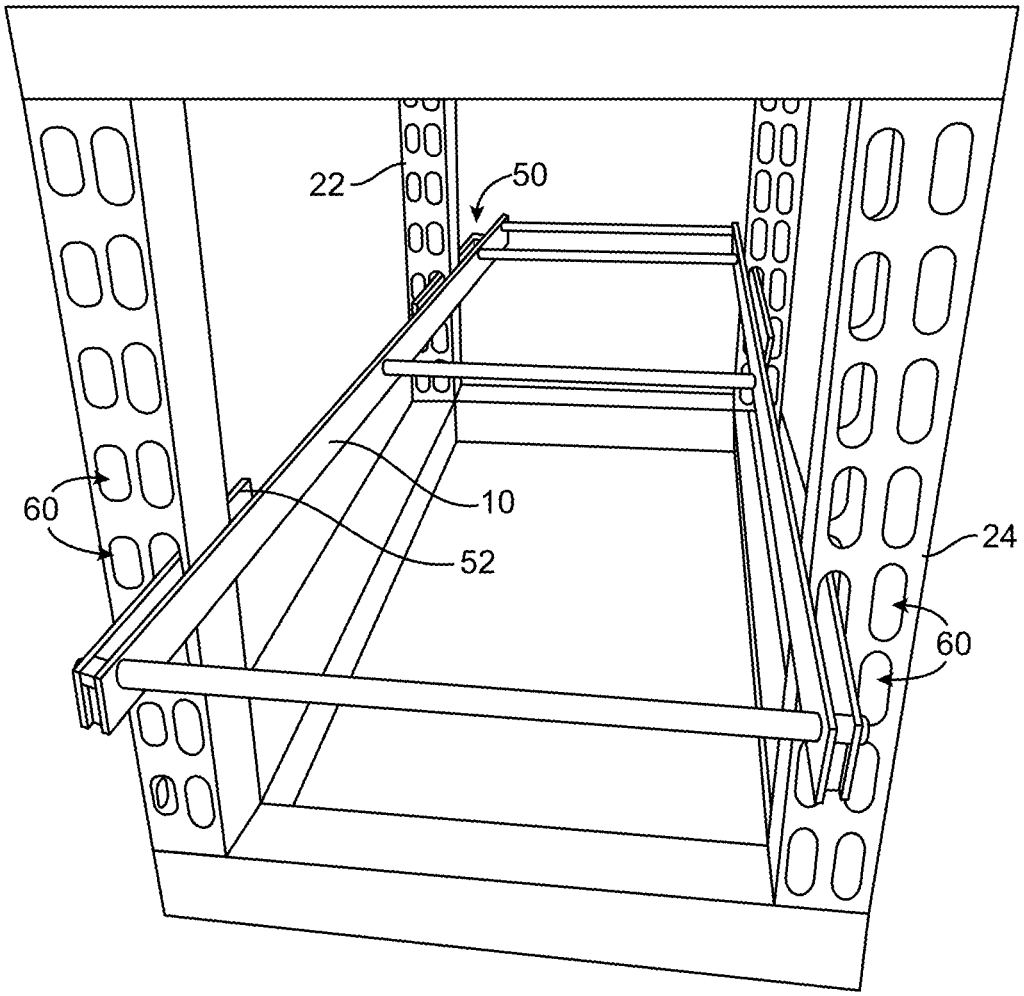
FIG. 1D is a simplified rear perspective view of the present system with the wireframe portion of the shelf removed for clarity of illustration showing the side support arms passing through apertures in front and rear vertical support posts.

FIG. 1D is a simplified rear perspective view of the present system with the wireframe portion of the shelf removed for clarity of illustration showing the side support arms 50 and 52 passing through apertures 60 in front and rear vertical support posts 22 and 24 respectively. Vertical posts 22 and 24 may be made with the same geometries or with different geometries. In addition, the shape of apertures 60 in these posts may be the same or different. Preferably, the shape of aperture 60 in each of vertical posts 22 and 24 will correspond to the shape of the side support arms 50 or 52 passing therethrough.

In preferred embodiments, the present system provides a shelving system, comprising:

(a) an assembly comprising:
- two front vertical posts 22 having a series of vertically spaced apart apertures 60 passing therethrough, and
- two rear vertical posts 24 having a series of vertically spaced apart apertures passing 60 therethrough; and (b) a shelf 10 comprising:
- a main body 11,
- a pair of front side support arms 50 extending out from opposite sides of a front portion of main body 11, wherein front side support arms 50 extend fully through the vertically spaced apart apertures 60 in the front vertical posts 22, and
- a pair of rear side support arms 52 extending from opposite sides of a rear portion of main body 11, wherein the rear side support arms 52 extend fully through the vertically spaced apart apertures 60 in the rear vertical posts 24.

Figures 2A, 2B, 2C:
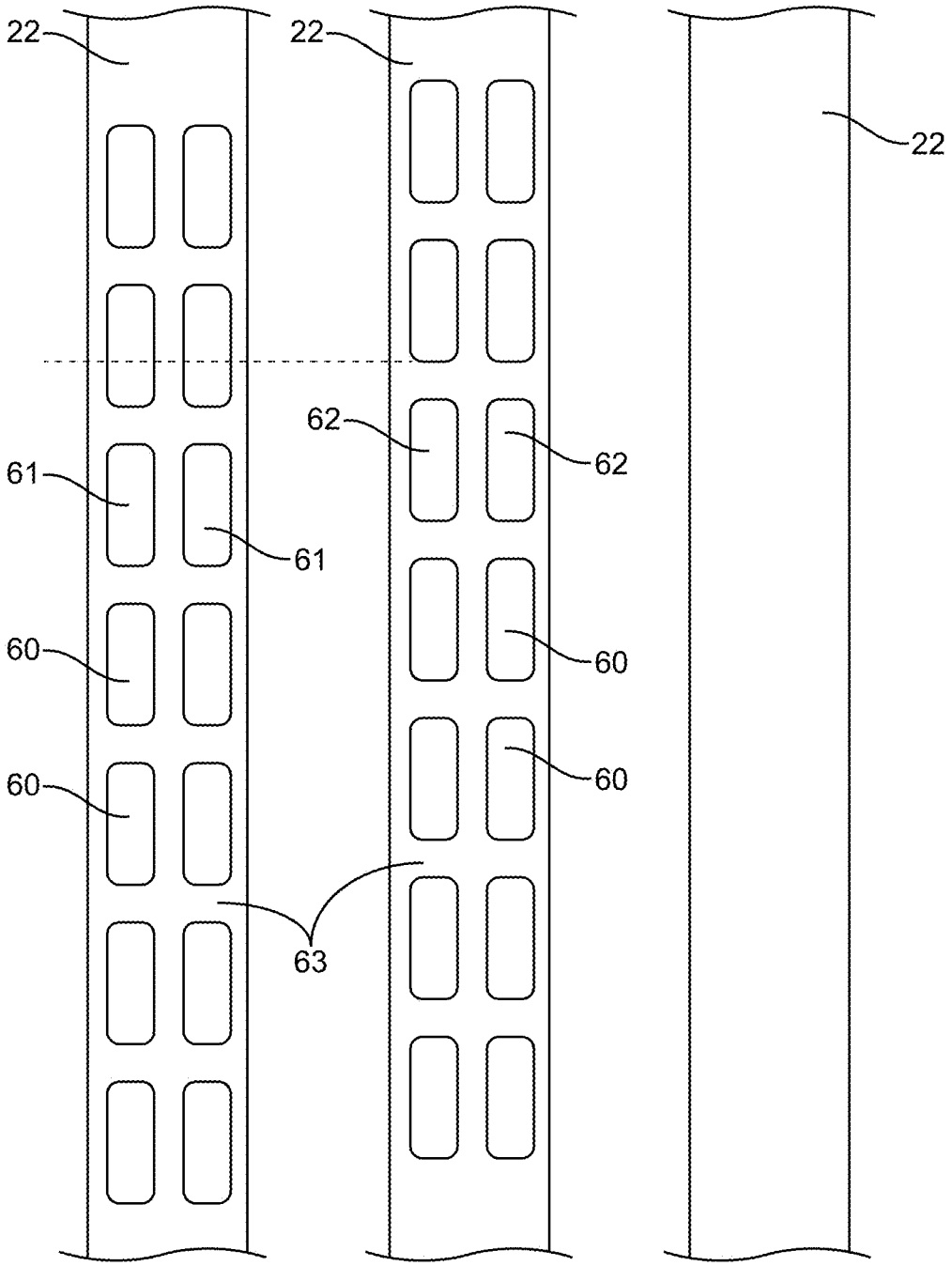
FIG. 2A is a front elevation view of one of the front vertical posts showing the position of the vertically spaced apart apertures passing through the front side of the post.
FIG. 2B is a rear elevation view of one of the front vertical posts showing the position of the vertically spaced apart apertures passing through the back side of the post.
FIG. 2C is a side elevation view of one of the front vertical posts.

The unique advantages of the present system are achieved by, among other things, having side support arms 50 and 52 extending outwardly from the sides of a shelf 10 and passing through apertures 60 in front and rear vertical posts 22 and 24. As will be shown, this provides a system where both the vertical and horizontal position of shelf 10 and the angle of shelf 10 can be adjusted and changed quickly and easily without the need for moveable inserts, brackets, S-hooks, etc. The preferred geometry and position of apertures 60 in front vertical post 22 is shown in FIGS. 2A to 2C. As can be seen, front vertical post 22 can be a hollow square tube. Apertures 60 include apertures 61 cut through the front face of the beam and apertures 62 cut through the back face of the beam. Front support arm 50 will pass through both of these apertures (61 and 62) as it passes fully through front post 22. In accordance with preferred embodiments, and as can be seen, corresponding apertures 61 and 62 are slightly offset from one another with front apertures 61 being slightly lower and back apertures 62 being slightly higher (as seen in the dotted line between FIGS. 2A and 2B). The importance of this detail will be seen more in FIG. 4. In alternate embodiments, side support arm 50 need not pass fully through vertical front post 22, but instead remain balanced on the back apertures 62.

Figure 3C:
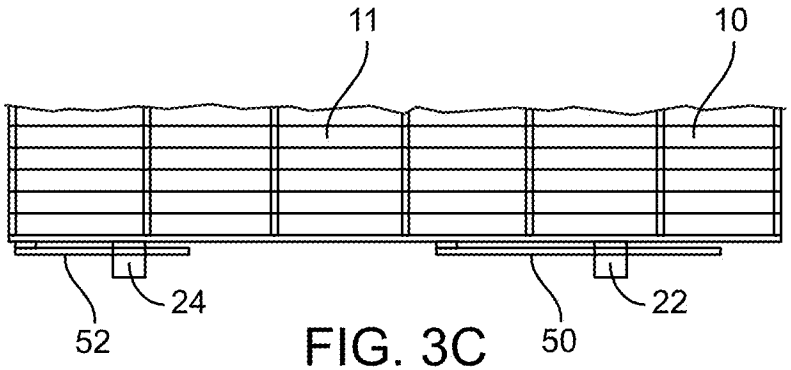
FIG. 3C is a top plan view similar to FIG. 3A, but after the rear end of the shelf has been moved to a raised position, thereby tilting the shelf forwards.
Figure 3D:
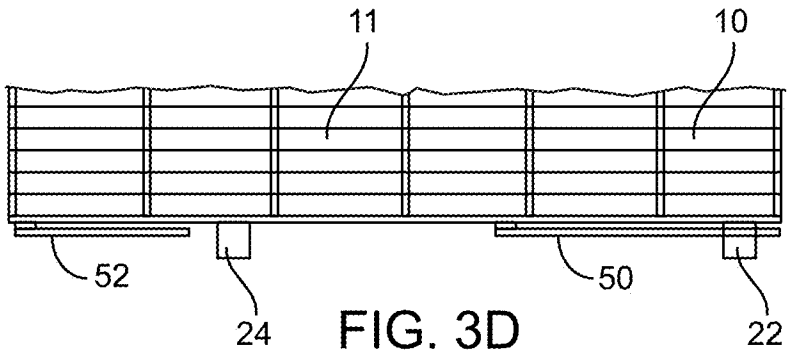
FIG. 3D is a top plan view similar to FIG. 3A, but after the rear end of the shelf has been pulled back to disconnect it from the back vertical post and dropped.
Figure 3A:
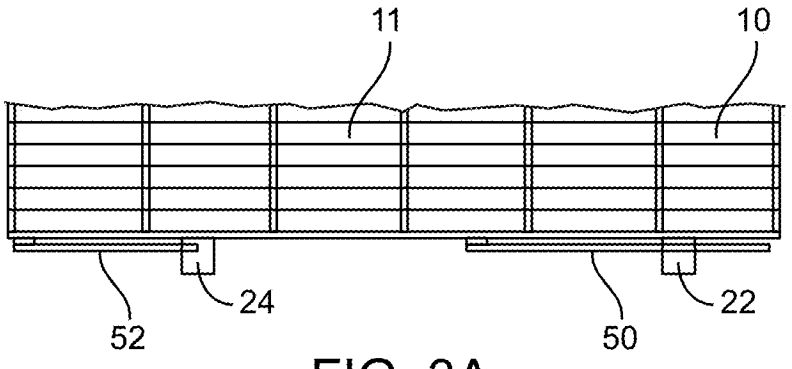
FIG. 3A is a top plan view of the shelf and the front and back vertical posts when the shelf is locked in a horizontal position.
Figure 3B:
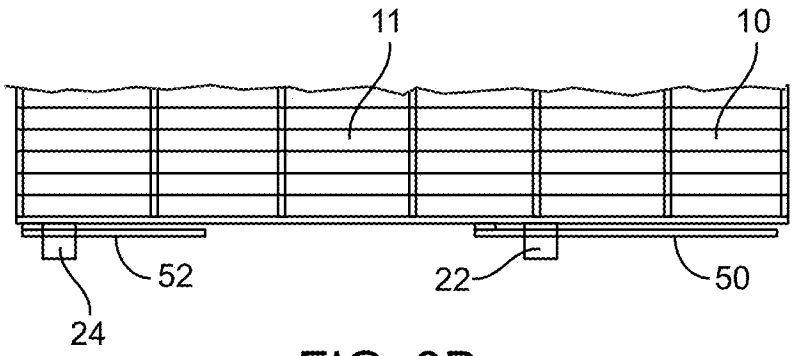
FIG. 3B is a top plan view similar to FIG. 3A, but after the shelf has been moved horizontally forwards.
Figure 4:
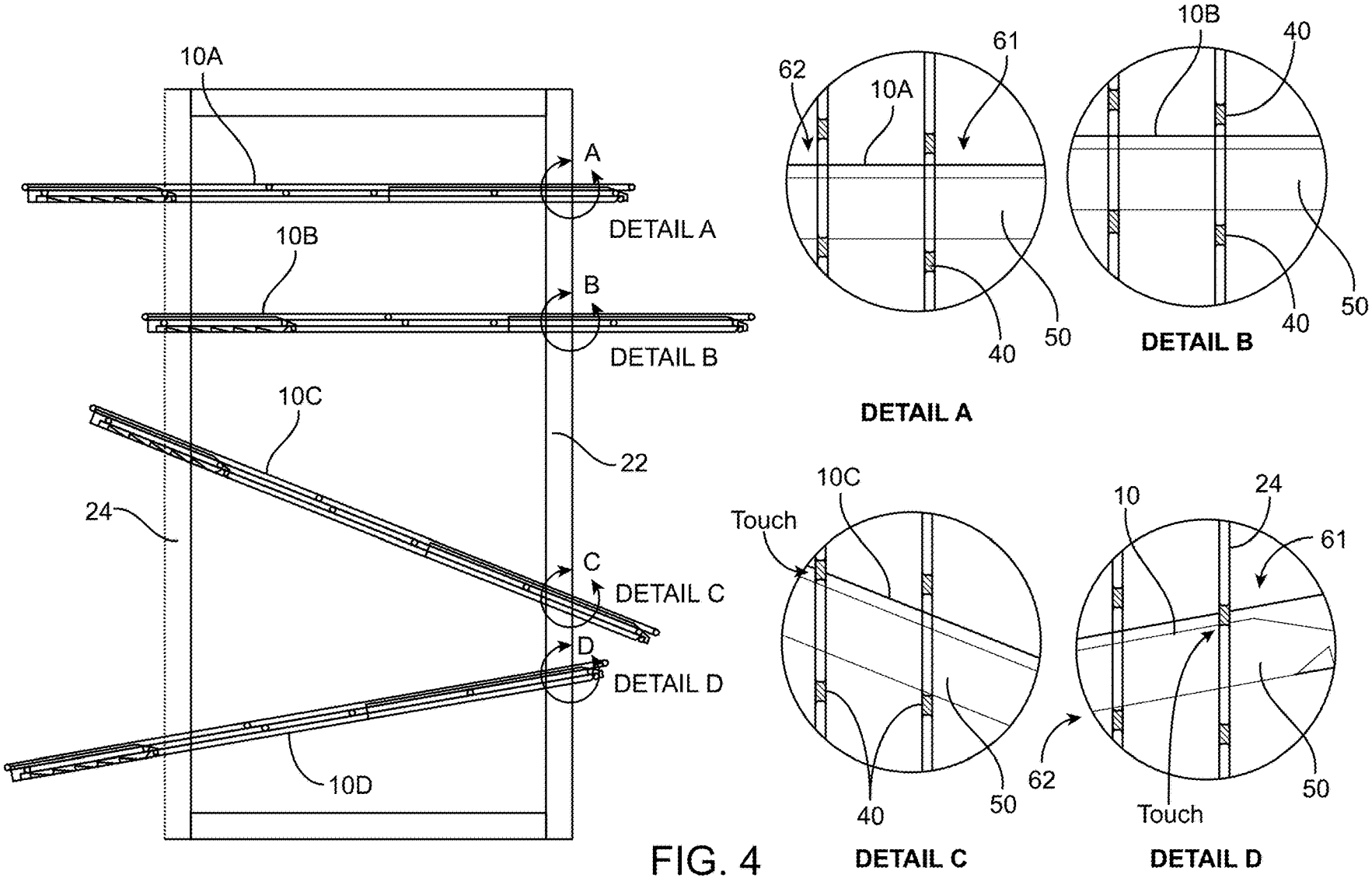
FIG. 4 is a side elevation view illustrating each of the various positions of FIGS. 3A to 3D. Detail views of each of these positions are also illustrated.

FIGS. 3A to 3D illustrate the interaction of side support arms 50 and 52 and vertical posts 22 and 24. FIG. 4 corresponds to each of these illustrated positions. Specifically, FIG. 3A corresponds to the position of shelf 10A in FIG. 4. FIG. 3B corresponds to the position of shelf 10B in FIG. 4. FIG. 3C corresponds to the position of shelf 10C in FIG. 4. Lastly, FIG. 3D corresponds to the position of shelf 10D in FIG. 4.

As such, FIG. 3A shows a first position of shelf 10 (10A in FIG. 4) in which front side support arms 50 pass through the apertures passing through front vertical post 22 and rear side support arms 52 pass through the apertures passing through rear vertical post 24. Next, as seen in FIG. 3B, shelf 10 (10B in FIG. 4) is pushed forwards. As such, front side support arm 50 projects farther out through front vertical post 22 while rear side support arm 52 will also move to project further through rear vertical post 24.

Next, the operator may desire to change the angle of the shelf. This is done by simply pulling shelf 10 backwards such that rear side support arms 52 are pulled out of apertures 60 in rear vertical post 24. This will fully disconnect rear side support arms 52 from rear vertical post 24. Since front side support arms 50 are longer than rear side support arms 52, the front side support arms 50 will not disconnect from front vertical post 22. Once the rear of the shelf has been disconnected, the operator can then decide to raise or lower this rear end of the shelf (thus tilting the shelf forwards or backwards, as desired). In FIG. 3C, the operator has selected to raise the rear end of shelf 10 (10C in FIG. 4). After the rear end of the shelf has been raised to a desired position, the operator then simply pushes the shelf forwards such that rear side support arms 52 reengage and pass through apertures that are located up higher on rear vertical post 24.

FIG. 3D illustrates an important novel safety feature of the present system. Specifically, in FIG. 3D, the operator has disengaged the rear side support arms 52 from rear vertical post 24, but then has inadvertently dropped the rear end of the shelf. In this situation, the rear end of shelf 10 (10D in FIG. 4) will fall some short distance. However, at this time, the front side support arms 50 will bind and lock into the apertures 60 in front vertical post 22. Specifically, as seen in the Detail view of FIG. 4, the top of front side support arms 50 will push up against the top of aperture 61 while the bottom of front side support arms 50 will push down against the bottom of aperture 62. This same orientation is shown by the top shelf 10 in FIG. 1C.

FIG. 4 illustrates the four vertically spaced apart shelves 10 of FIGS. 3A to 3D stacked above one another in a shelving system. Shelves 10A and 10B are horizontal. The Detail views corresponding to shelves 10A and 10B show the front side support arms 50 passing between the front and rear apertures 61 and 62. As can be seen, the bottom edge of front side support arms 50 rests on top of rear aperture 62.

Next, shelf 10C has had its rear end raised and the shelf is tilted forwards. The corresponding Detail view shows the maximum angle for this system's geometry where the top of front side support arms 50 hit and push against the top of rear aperture 62 while the bottom of front side support arms 50 sits on the bottom edge of front aperture 61.

Lastly, shelf 10D has had its rear end unlocked (released from rear vertical posts 24) and then accidently dropped. In accordance with the present safety system, shelf 10D does not simply detach and fall to the ground or on top of a lower shelf. Instead, shelf 10D will tilt backwardly until it reaches a position where its front side support arm 50 binds and locks into the apertures with the bottom of the front side support arm 50 resting on the bottom of rear aperture 62 and the top of front side support arm 50 butting against the top of front aperture 61. (See also the top shelf in FIG. 1C).

Figure 5A:
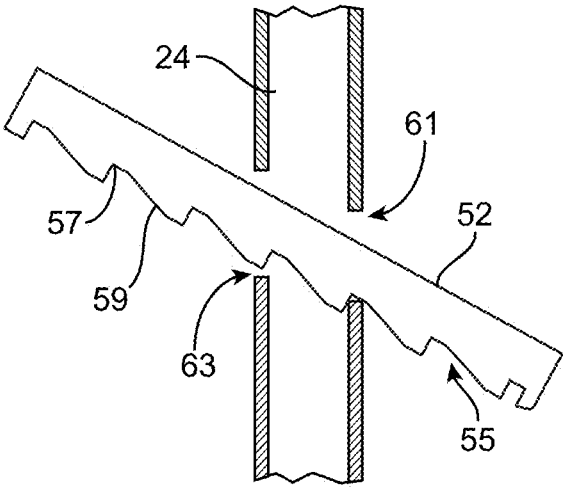
FIG. 5A is a sectional side elevation view of a notched rear side support arm in an inclined position latching onto one of the apertures in the front of the rear vertical post.
Figure 5B:
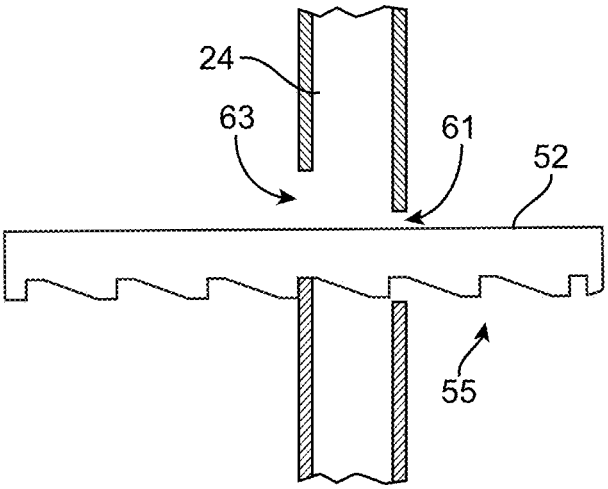
FIG. 5B sectional side elevation view of a notched rear side support arm in a horizontal position latching onto one of the apertures in the rear of the rear vertical post.

In accordance with various preferred aspects of the present system, the rear side support arms have a series of bottom notches 55 thereon. These notches may be of different shapes. For example, notches 55 may be cactus-shaped, saw-tooth shaped, hook-shaped, sinusoidal in shape, projections or extensions coming from the bottom of the side support arms, etc. In one embodiment, notches 55 may be cactus-shaped or saw-tooth shaped as illustrated having a straight portion 57 and an angled portion 59. As can be seen in FIG. 5A, the straight portions 57 of the notches can lock against the edges of the vertically spaced apart front apertures 61 in the vertical rear posts 24. Alternatively, or in addition, the straight portions 57 of the notches may also lock against the edges of the vertically spaced apart rear apertures 62. As seen in FIG. 5B, the notches 55 can also lock against the edges of the front and back apertures 61 and 62 while the shelf is in a horizontal position.

Figure 6A:
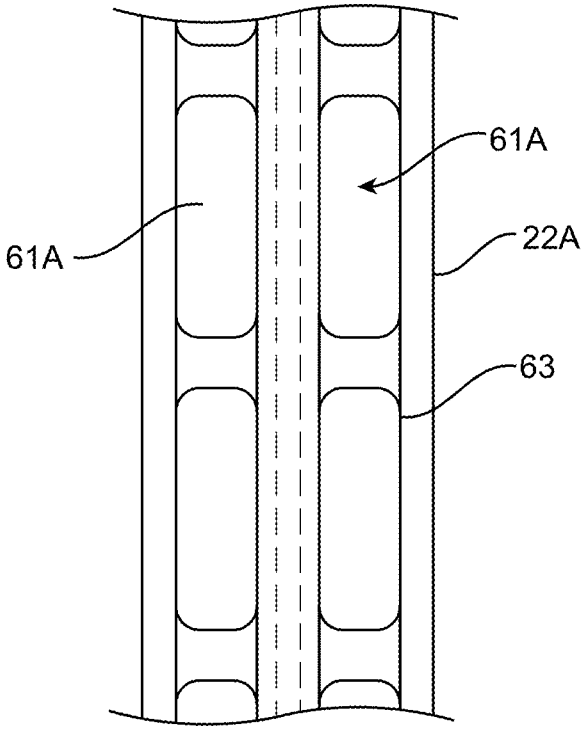
FIG. 6A is a front elevation view of a T-shaped vertical front post having a series of apertures passing therethrough.
Figure 7A:
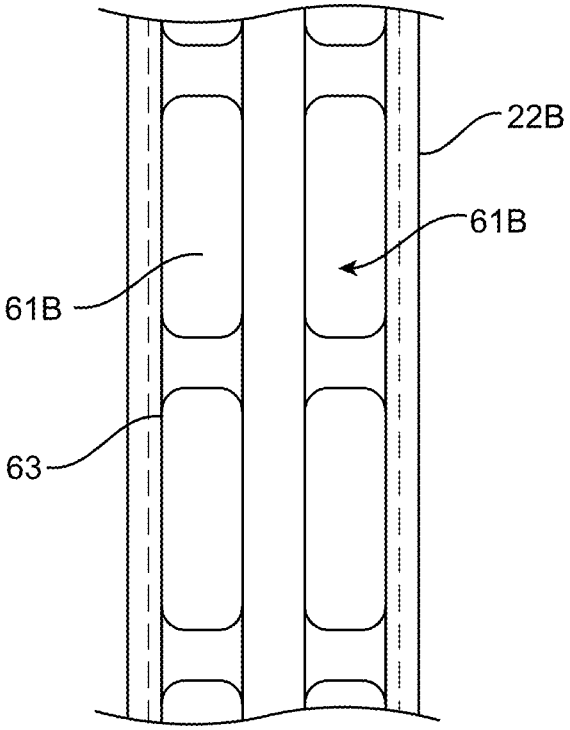
FIG. 7A is a front elevation view of a U-shaped vertical front post having a series of apertures passing therethrough.
Figure 6B:
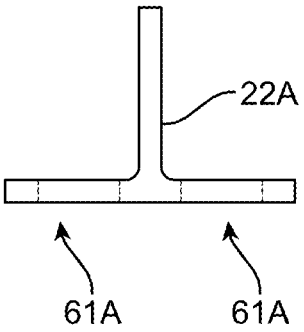
FIG. 6B is a top plan view corresponding to FIG. 6A.
Figure 7B:
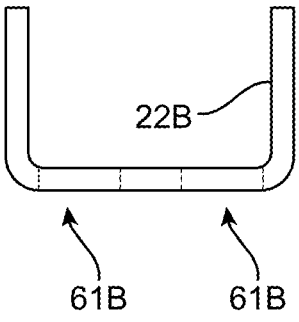
FIG. 7B is a top plan view corresponding to FIG. 7A.

In the various preferred embodiments described above, the front and rear vertical posts 22 and 24 are rectangular in cross section. It is to be understood, however, that the present system is not limited to only hollow square or rectangular designs. For example, FIGS. 6A and 6B illustrate a T-shaped cross section front vertical post 22A having apertures 61A passing through only one plane of material. Similarly, FIGS. 7A and 7B illustrate a C-shaped cross section front vertical post having apertures 61B again passing through only one plane of material. In both of the embodiments of FIGS. 6A to 7B, front side support arms 50 can bind against the top and bottom of the apertures 61B if the rear of the shelf is detached from rear vertical post 24 and inadvertently dropped. It is to be understood that in these embodiments, the sizes of apertures 61A and 61B are expected to more closely match the height of the front side support arms 50 to obtain a more optimal fit. This may also necessitate shelf 10 having more limited mobility in terms of tilting rotation forwards or backwards as compared to the previously described embodiments that use a hollow square front vertical post 22 (which would have points of contact at both front apertures 61 and at back apertures 62).

In an alternate embodiment, rear side support arms 52 are longer than rear side support arms 50. As such, an operator standing at the front of the system can adjust the position of the shelf by pushing it back to detach side support arms 50 from front vertical post 22. Next, the front of the shelf can be raised or lowered as desired, and then reattached to front vertical post 22. In the event that the front of the shelf is accidently dropped, the rear side support arms 52 will bind within apertures 60 in rear vertical post 24, preventing the shelf from falling.

Figure 8:
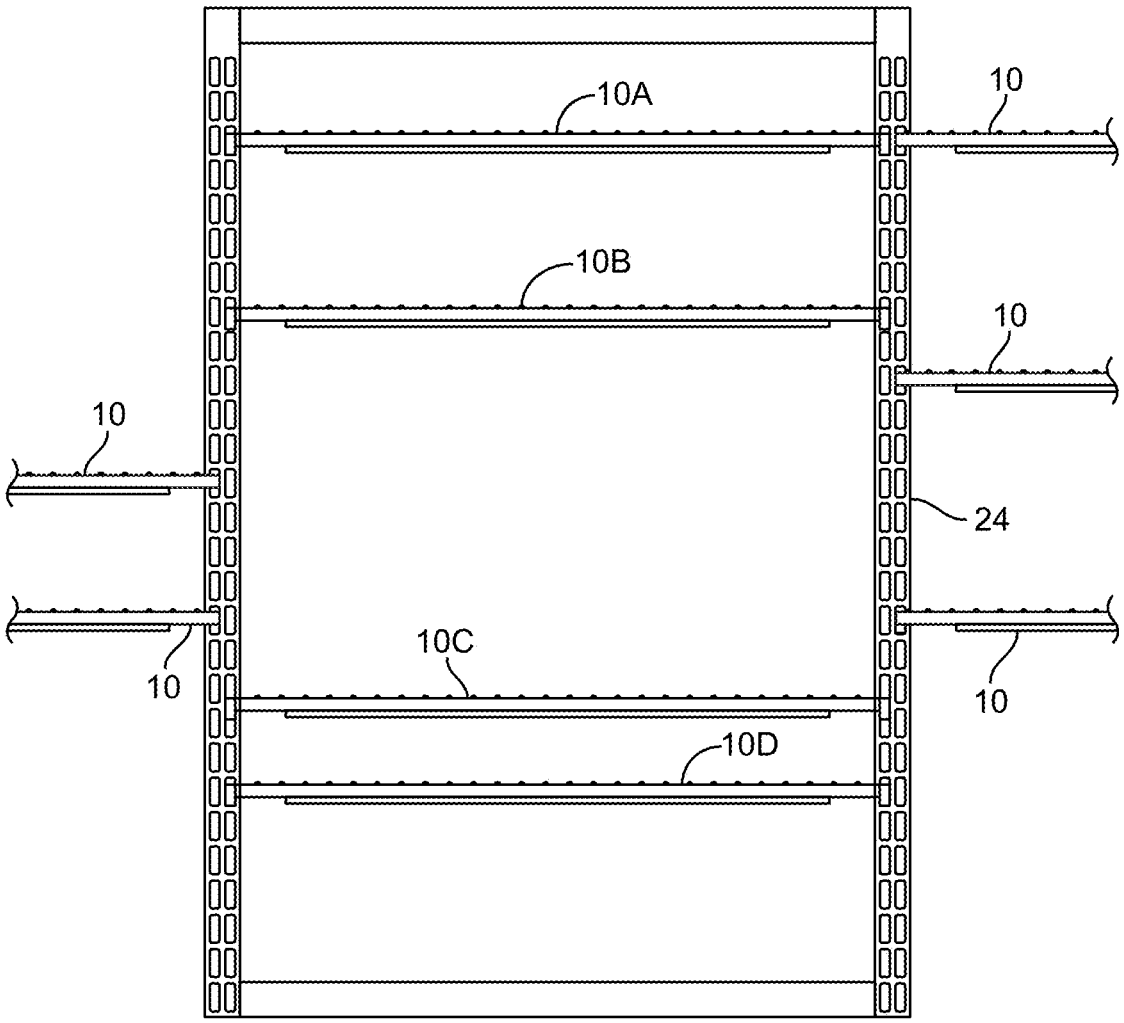
FIG. 8 is a rear elevation view showing additional shelves to the left and right of the system showing how the vertical posts can support shelves on either side.

Lastly, FIG. 8 illustrates a rear view of the system illustrated in FIG. 4 (but with shelves 10C and 10D having been returned to their horizontal position. As can be seen, the rear of posts 24 have pairs of apertures 62 on their back sides. As seen in previous Figures, front posts 22 also have pairs of vertically spaced apart apertures 60 on their front and back as well. As seen in FIG. 8, this permits additional shelves 10 to be hung from the left and right sides of these vertical posts. As such, the present system can be used in large display cabinets with multiple shelves extending to the left and right while these shelves are supported by shared front and back vertical posts.

In the illustrated embodiments, vertical posts 22 and 24 can together form a frame around the shelf. These bars may optionally be connected together by additional top, bottom or side members to form a frame or a box-like enclosure. It is to be understood that many different geometries are possible, and that vertical posts 22 and 24 may be attached together in different ways using different geometries, all keeping within the scope of the present system. For example, vertical posts 22 and 24 can be connected to systems that use or include refrigerator doors. The present system can optionally be constructed by attaching the front posts 22 to the doorframe and the rear posts 24 can be freestanding and held in place by the shelves. Other alternatives and designs are also contemplated, all keeping within the scope of the present invention.

In all of its various embodiments, the present system provides an elegant and non-obvious mechanism for positioning shelf 10 with respect to the vertical posts 22 and 24 (or frame encompassing these vertical posts) such that the angle and horizontal position of shelf 10 can be adjusted by moving the shelf quickly, easily and safely without the need for moveable inserts, brackets, S-hooks, etc.

What is claimed is:

1. A shelving system, comprising:

(a) an assembly comprising:

two front vertical posts having a series of vertically spaced apart apertures in a front wall and a back wall therein, and two rear vertical posts having a series of vertically spaced apart apertures in a front wall and a back wall therein; and (b) a shelf comprising:

a main body, a pair of front side support arms extending from opposite sides of a front portion of the main body, wherein the front side support arms extend through the vertically spaced apart apertures in the front and back walls of the front vertical posts, and a pair of rear side support arms extending from opposite sides of a rear portion of the main body, wherein the rear side support arms extend through the vertically spaced apart apertures in the front and back walls of the rear vertical posts, and wherein at least one of the front or rear side support arms have a series of bottom notches or protrusions thereon that lock onto the apertures in the front wall of the front or rear vertical posts when the shelf is in an inclined position and lock into the apertures in the back wall of the front or rear vertical posts when the shelf is in a horizontal position.

2. The shelving system of claim 1, wherein the notches are saw-tooth shaped.

3. The shelving system of claim 2, wherein the saw-tooth shaped notches have a straight portion and an angled portion, and wherein the straight portions of the notches lock against side edges of the vertically spaced apart apertures in the rear or front vertical posts determining the front to back position of the shelf with respect to the front or rear vertical posts.

4. The shelving system of claim 2, wherein the bottom notches lock onto the vertically spaced apart apertures in the rear vertical posts.

5. The shelving system of claim 1, wherein the front side support arms are longer, shorter or the same length as the rear side support arms.

6. The shelving system of claim 1, wherein the rear portion of the shelf can be lifted to tilt the shelf forwardly while the front side support arms extend into the vertically spaced apart apertures in the front vertical posts.

7. The shelving system of claim 1, wherein the rear portion of the shelf can be released and dropped to tilt the shelf backwardly while the front side support arms extend into the vertically spaced apart apertures in the front vertical posts.

8. The shelving system of claim 1, wherein the rear side support arms can be withdrawn from the vertically spaced apart apertures in the rear vertical posts and the rear portion of the shelf can be released and dropped to tilt the shelf backwardly while the front side support arms extend into the vertically spaced apart apertures in the front vertical posts.

9. The shelving system of claim 1, wherein a user can withdraw the rear side support arms from the vertically spaced apart apertures in the rear vertical posts and then raise or lower the rear portion of the shelf while the front side support arms extend into the vertically spaced apart apertures in the front vertical posts.

10. The shelving system of claim 1, wherein the front side support arms are configured to rotate to lock against a top and a bottom of the vertically spaced apart apertures of the front vertical posts if the rear side support arms are removed from the vertically spaced apart apertures in the rear vertical posts and the rear portion of the shelf is released.

11. The shelving system of claim 1, wherein the front and rear vertical posts are hollow and are rectangular or tubular in cross section.

12. The shelving system of claim 1, wherein the front and rear vertical posts are T-shaped, U-shaped or C-shaped in cross section.

13. The shelving system of claim 1, wherein the front and rear vertical posts have a single series of spaced apart apertures passing therethrough.

14. The shelving system of claim 1, wherein the series of vertically spaced apart apertures on each of the front and rear vertical posts comprise pairs of apertures for supporting shelves on each of left and right sides of the vertical posts.

15. The shelving system of claim 1, wherein the shelf is a wireframe shelf.

* * * * *